US011134801B2

(12) United States Patent
Mun

(10) Patent No.: US 11,134,801 B2
(45) Date of Patent: Oct. 5, 2021

(54) THERAPEUTIC HEAD PILLOW AND SUPPORTING BODY PILLOW

(71) Applicant: Yong C Mun, Henderson, NV (US)

(72) Inventor: Yong C Mun, Henderson, NV (US)

( * ) Notice: Subject to any disclaimer, the term of this patent is extended or adjusted under 35 U.S.C. 154(b) by 0 days.

(21) Appl. No.: 17/169,462

(22) Filed: Feb. 6, 2021

(65) Prior Publication Data

US 2021/0244211 A1 Aug. 12, 2021

Related U.S. Application Data

(60) Provisional application No. 62/970,900, filed on Feb. 6, 2020.

(51) Int. Cl.
*A47G 9/10* (2006.01)

(52) U.S. Cl.
CPC ..... *A47G 9/109* (2013.01); *A47G 9/1054* (2013.01); *A47G 2009/1018* (2013.01)

(58) Field of Classification Search
CPC ..... A47G 9/109; A47G 9/1054; A47G 2009/1018; A47C 20/025; A47C 20/026
See application file for complete search history.

(56) References Cited

U.S. PATENT DOCUMENTS 1,548,728 A * 8/1925 Milam ..... A61G 7/072 5/722
3,124,812 A * 3/1964 Milton et al. ..... A47G 9/10 5/638
3,608,103 A * 9/1971 Seid ..... A47C 20/026 5/661
3,849,810 A * 11/1974 Degen ..... A47G 9/109 5/640
4,382,306 A * 5/1983 Lickert ..... A47C 20/025 5/631
4,397,052 A * 8/1983 Lund, III ..... A47C 20/025 5/631
4,489,452 A * 12/1984 Lickert ..... A47C 20/025 5/710
4,665,573 A * 5/1987 Fiore ..... A47C 27/148 5/731
4,688,283 A * 8/1987 Jacobson ..... A47C 27/081 5/709

(Continued)

*Primary Examiner* — Eric J Kurilla

(57) ABSTRACT

This invention represents converting a conventional pillow into a therapeutic brio top head pillow in conjunction with a body pillow by creating a base for the pillow embodiment apparatus comprising of assembling two or more pieces, as necessary, of the embodiment and encasing the entire configuration with corpulent materials which would become comparable to a standard/queen conventional pillow along with a body pillow. Each piece of the embodiment comprises a flat face on one side and three tiered layers of bilateral symmetrical configuration from the center toward the outwards-opposing directions laterally. The assembly can be done as a face to face or back to back attachment of each side and encasing with materials. This pillow comprises a soft foam and/or other types of corpulent soft cushion for both the interior embodiment and/or casing. This system and method induces and compliments self adjustments of depth and width of indentation to fit the occiput, which is based on the pressure, size, and weight of a person's head, neck, and body.

2 Claims, 11 Drawing Sheets

Three (or four) Part Attachment Method

(56) References Cited

U.S. PATENT DOCUMENTS 4,901,384 A * 2/1990 Eary ..... A47C 20/021 5/632
4,944,059 A * 7/1990 Wall ..... A47C 20/025 5/631
4,987,625 A * 1/1991 Edelson ..... A47C 20/026 5/420
5,216,771 A * 6/1993 Hoff ..... A47C 20/021 5/490
5,400,449 A * 3/1995 Satto ..... A47C 20/021 5/631
5,479,667 A * 1/1996 Nelson ..... A47G 9/10 5/636
5,504,953 A * 4/1996 Singer-Leyton ..... A47C 27/15 5/631
5,509,153 A * 4/1996 Roschacher ..... A47C 20/025 5/707
5,632,050 A * 5/1997 Zajas ..... A47C 20/026 5/632
5,778,887 A * 7/1998 Curtiss ..... A47C 20/026 128/845
5,890,246 A * 4/1999 Davis ..... A47C 27/081 5/735
6,038,722 A * 3/2000 Giori ..... A47C 27/084 5/709
6,081,947 A * 7/2000 Disher ..... A47C 20/026 248/118.3
6,185,768 B1 * 2/2001 Schlechter ..... A47C 20/026 5/632
6,513,179 B1 * 2/2003 Pan ..... A47G 9/109 5/636
7,020,918 B1 * 4/2006 Tinsley ..... A47C 16/00 5/630
7,127,764 B1 * 10/2006 Harding ..... A47C 20/00 5/735
7,536,741 B1 * 5/2009 Schultz ..... A47C 27/146 5/733
7,661,163 B1 * 2/2010 Gallaher ..... A47C 20/021 5/632
8,074,310 B1 * 12/2011 Robbins ..... A47C 20/025 5/632
8,434,176 B1 * 5/2013 Harrison ..... A47C 20/023 5/632
8,732,877 B2 * 5/2014 Ramp ..... A47C 20/027 5/632
2009/0178202 A1 * 7/2009 Kovalyak ..... A47C 20/026 5/655
2010/0199436 A1 * 8/2010 Schultz ..... A47C 20/00 5/632
2011/0056503 A1 * 3/2011 Abraham ..... A47C 20/026 128/845
2013/0081208 A1 * 4/2013 Dyevich ..... A47C 27/15 5/727
2013/0145555 A1 * 6/2013 Hargreaves ..... A47C 27/15 5/655
2013/0245395 A1 * 9/2013 Bidarian Moniri ..... A61B 7/00 600/301
2014/0215719 A1 * 8/2014 Gibbons ..... A47C 20/021 5/632
2014/0359944 A1 * 12/2014 Thompson ..... A61G 13/122 5/636
2016/0128500 A1 * 5/2016 Yuyungyuen ..... A47G 9/1054 5/632
2018/0063612 A1 * 3/2018 Fuchs ..... H04R 5/023
2018/0184820 A1 * 7/2018 Johnson ..... A47G 9/109
2020/0337479 A1 * 10/2020 Zurek ..... A47G 9/109
2021/0037995 A1 * 2/2021 Dompierre ..... A47C 31/10
2021/0068562 A1 * 3/2021 Cuthbert ..... A47G 9/10

* cited by examiner

Therapeutic Head Pillow and Supporting Body Pillow

Exterior View Of Completed Pillow

Two Part Attachment Method (Option 1)

Reverse Attachment of Fig. 2 (Option 2)

Three (or four) Part Attachment Method

Horizontal and vertical inside view indicator

Fill In With Balloon or Other Product Options
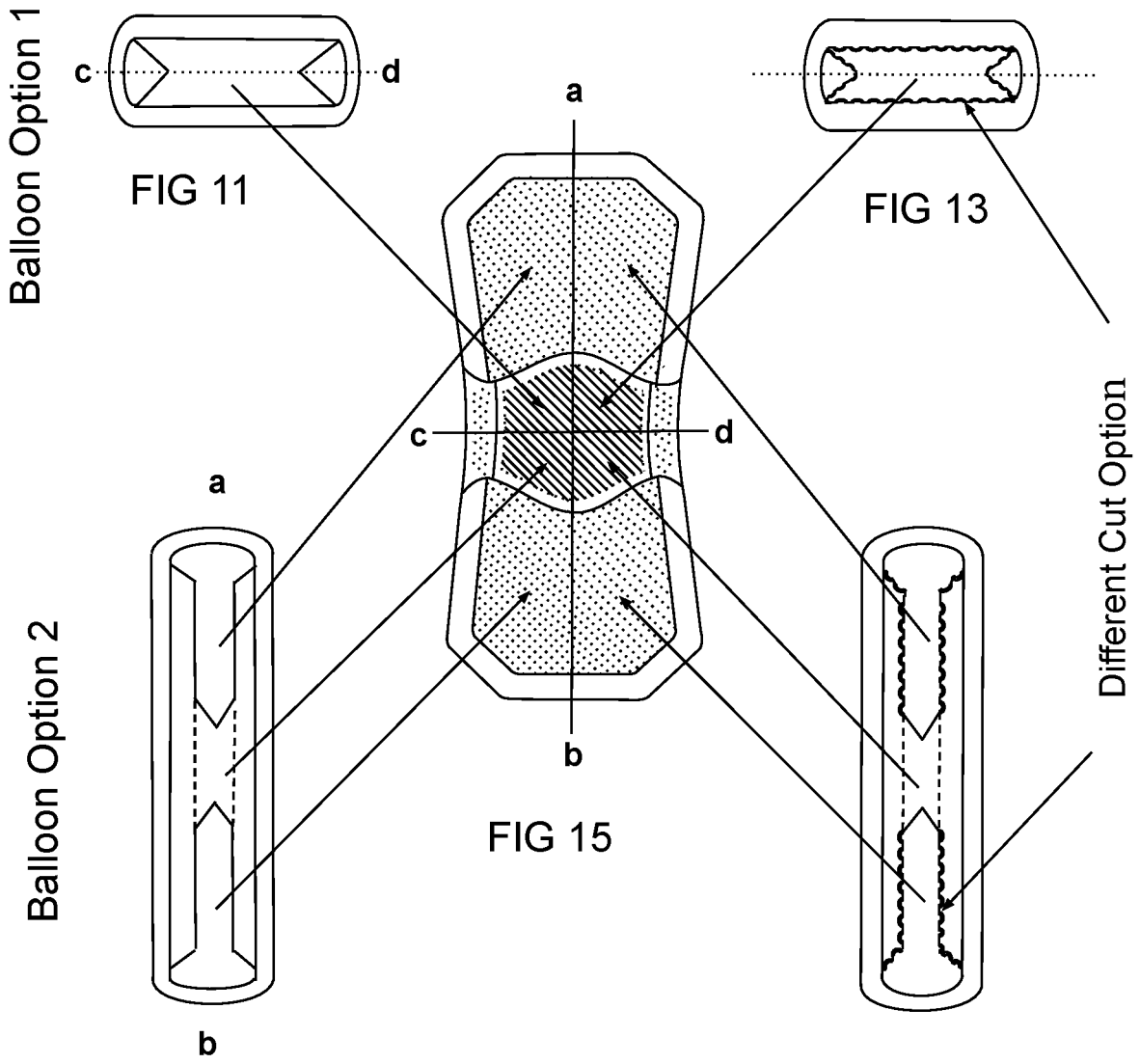

Exterior View Of Body Pillow

Exterior View Of Head and Body Pillow

Exterior View Of Head and Body Pillow

Vertical Cut View

Horizontal Cut View

Exterior ornamental design option
FIG 23
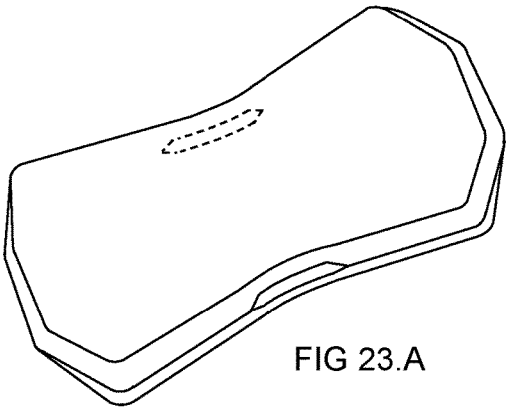
FIG 23.A
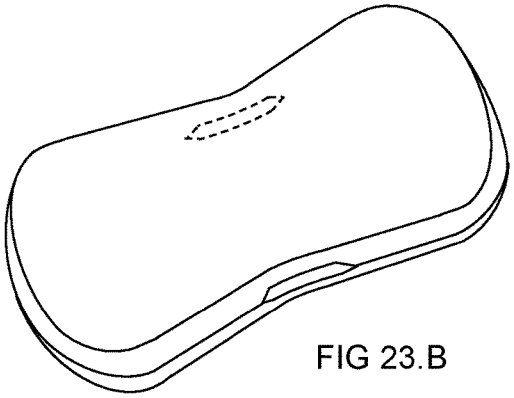
FIG 23.B
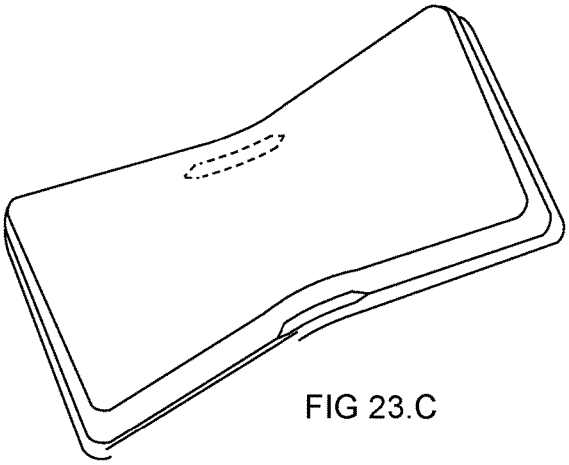
FIG 23.C
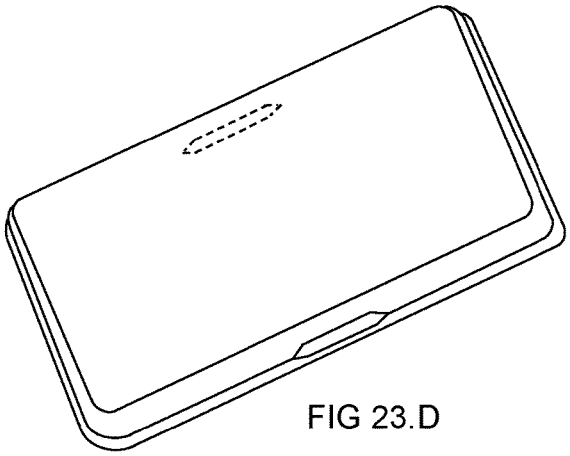
FIG 23.D
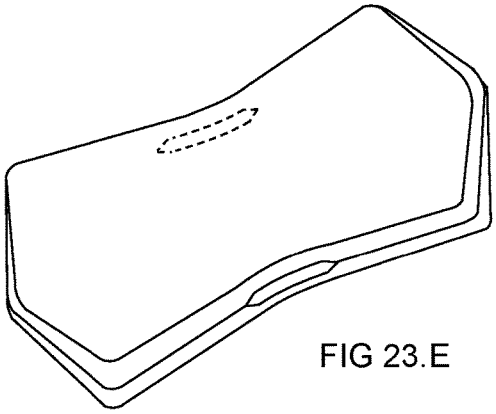
FIG 23.E

THERAPEUTIC HEAD PILLOW AND SUPPORTING BODY PILLOW

BACKGROUND OF INVENTION

The most conventional pillows are typically rectangular in shape and mostly puffy in the center of the pillow. Since the human head is an oval shape, finding a comfortable position while sleeping is sometimes cumbersome. When a user is lying on their supine position, both the head and pillow supposedly contact with the highest points on each other. But on the other hand, when a user lies on the side position, most likely the pillow is not high enough because the human shoulders are at a greater distance between one's neck and surface compared to the back of one's neck and surface. This eventually causes discomfort and pain to the upper body anatomy. Therefore, many people use multiple pillows or put their hand or arm under the pillow when they are on the side sleeping position to adjust their pillow height in order to get a comfortable position. Raising the occiput too high on the supine lying position potentially creates a disalignment on their cervical and thoracic spine system.

There are many prior art for therapeutic pillows that have the resemblance of assembly and stack of blocks or limited space to some users. Therefore, the conventional pillows are still dominated in the marketplace based on commercial advertisements, shelf space in stores, and displays elsewhere.

Unlike most of the prior art therapeutic pillows, this head pillow is generally comparable to the standard/queen size of the conventional pillow and is designed to work well for various sizes and shapes for the upper body anatomy of users for minor adjustments based on the different size categories such as small, medium, and large. This is done by creating an embodiment apparatus consisting of different depths and widths of indentations with multiple tiered systems and case up the entire assembled prefabricated embodiment apparatus using a soft foam or corpulent products for embodiments. This method creates a system which allows automatic adjustments to users depending on the size and weight of their head and shoulders and works along with the opposing side layers. This invention is intended to help the most problem areas of the spinal anatomy, and users can sleep comfortably in the same way as they would with their conventional pillow together with the body pillow.

This invention includes a body pillow which associates with a head pillow as explained. The head and body pillow would provide a complete support for all regions of the spinal anatomy. The hip section of the human body is a convex shape and most mattresses are not soft enough or too soft, therefore the middle section of the body sinks and creates a misalignment of spinal column. On the other hand, the hip area is convex, when the hip area of the body is not properly positioned, starting from the lumbar region of the spine through the feet area would be disrupted. The body pillow is equally important as the head pillow and recommended to be utilized in conjunction with the head pillow for maximum benefit and manufactured that is similar in method to the head pillow with different indentations to fit the body shape.

BRIEF SUMMARY OF THE INVENTION

Figure 1:
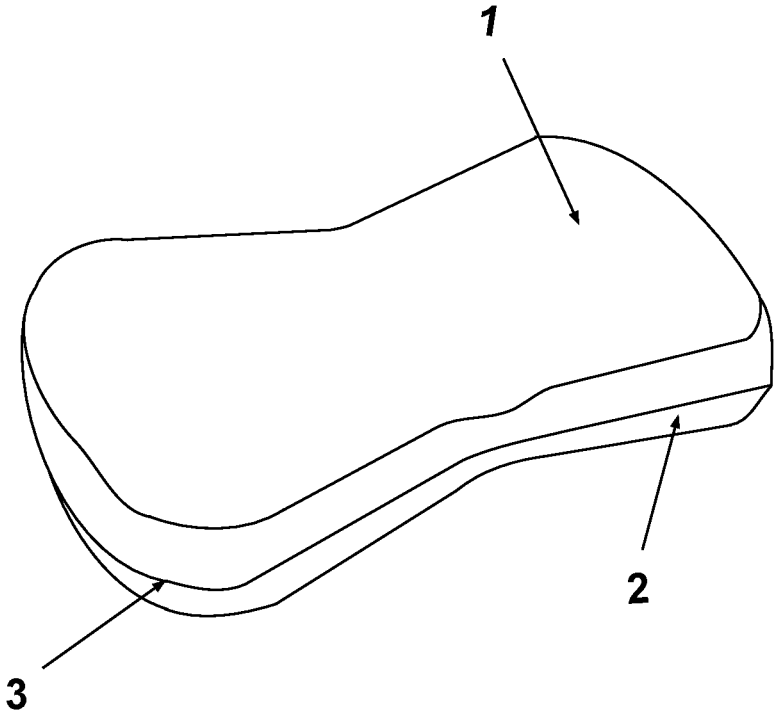
FIG. 1 Overall view of completed brio top pillow
FIG. 2 Two part attachment method (Option 1)
FIG. 2.A Two piece assembly, top layer—option 1
FIG. 2.B Two piece assembly, bottom layer—option 1

This invention, which comprises a brio top head pillow and body pillow is intended to solve and prevent cervical, thoracic, and the remaining regions of the spinal system from having discomfort or severe pain that might be caused by using improper pillows and bed mattresses.

First, this head pillow, which is comparable to a standard/queen conventional pillows, unlike many prior art therapeutic pillows, is designed to support the cervical and thoracic spine alignment by creating embodiment apparatuses with a multiple tier level system comprising of three panels (center, left, and right) with various thicknesses and indentation to accommodate for placing the head, neck, and the shoulder areas in a proper position while a person is sleeping on either a supine or side sleeping position. This would be done by using a soft foam or similar products used in the pillow industry and applying a case to the prefabricated embodiment apparatus with a corpulent material to complete the pillow for self adjusting.

The center section of pillow, in which for the neck and shoulder areas, is the lowest part of the pillow and to be raised up using the tier system to the left and right from the center towards the outer directions and similarity on the opposing side. The center area is defined as both the middle section of the parallel horizontal and vertical section and they are one inch (+/−) shorter than the outer vertical parallel left and right edges as well as the parallel top and bottom edges (or use: parallel left, right, top and bottom edges). Each corner of the center section should be connected to the same side of the vertical ends. Therefore, the pillow is slightly angled (15-20 degree) connecting from the center parallel lines to the same side outer vertical lines of the left and right panel. This method is to help the position of the head and shoulders when a person rolls over to left or right side lying positions from the supine position. Typically, when a person is lying on the side position, the body is slightly inclined and the head is angled on the pillow to the left or right orientation. Therefore, this horizontal concave shape pillow will accommodate the situation for back lying and side lying positions.

This indentation and multiple tiers can be done on only one side and is flat on the lateral opposing side of the structure, then, can be assembled by using specially made glue for a foam, zipper system, or any other method of attachment in which it works the same with two or more pieces of prefabricated apparatus. There are different methods of assembling the pieces which can be done in-different ways. The first method is where both flat areas are facing outside, called option 1, and both flat sides are facing together, which is the reverse method of option 1 called option 2. Option 1 might not require an additional layer of casing, but it is optional. Option 2 comprises a casing with soft foam or various types of corpulent soft cushion materials to cover the entire base, the internal embodiment of the pillow. Both options can be manufactured as one piece in some manner.

The first tier comprises of a large slanted hole in the center, similarly oval, hexagon, octagon, square, rectangular, or any desired shape to create room so an occiput can go deeper to line up the cervical spine, and the remaining spaces of the first tier of the left and right panels from the center are for the side of head for the side lying position. The second tier is narrow and has a slanted (sloped) foam along the outline of the first tier except for both the top and bottom of the center of the horizontal sections—in order to reduce the height for the neck for the back lying position. The left and right side panel of the vertical of the second tier is to hold and cuddle the head, and horizontal lines of the left and right panels are for neck support and they are slightly wider than said vertical lines. The exterior tier of the corpulent layer, and exterior layer of option 1 and casing for option 2, which fluctuates to support the pressure control to help for self adjusting depth and widths of the pillow along with opposing sides of layers, based on the size and weight of the person's head and neck and provides for flexibility of a pillow.

Ultimately, this system and method will provide users to transit smoothly from the supine position to the left or right lateral recumbent position because the joints of compartments are slanted (sloped) and covered with corpulent materials, in other words, no axis between compartments. Also, this system method makes it easier for stomach sleepers.

Second, this invention includes a body pillow and should be located adjacent to the head pillow where the center of the horizontal curvature area is located and used in conjunction with the head pillow in order to accomplish full support of the remaining region of the spinal anatomy alignment. The human hip area is a convex shape and even a soft mattress might not fully support the lumbar region of the spinal curve and hip joints. When the lumbar curvature and the hip lines are not aligned, the rest of the lower body will lean on the surface of the bed improperly. This body pillow is structured in a similar method to the head pillow to put the human hip area in the proper position and is treated the same as the occiput of the human head. An extension piece will be available for the length adjustments for the body pillow. This body pillow might work very well for stomach sleepers, however, it might need to be turned 180 degrees for the upper and lower body area of the body pillow. The space between the head pillow and body pillow naturally creates room for arms and shoulders for the side sleeping position to release pressure from the surface of the body pillow.

The size and shape of the head and body pillow apparatus can be adjusted to meet the users need or can be customized under the similar system and method. Furthermore, this head and body pillow can be attached together or make a one piece in some manner especially for children or for new born babies. These methods can be optional or custom designed.

This system and method is not limited to making head or body pillows only, and either one can be utilized on any other similar products, such as couches, chairs, or car seats, etc.

Multiple choices of pillow shapes (five suggested samples in drawings) are available, as well as various pillow sizes or multiple tier system patterns.

DETAILED DESCRIPTION OF THE INVENTION

This invention represents a brio top head pillow conjunction with a body pillow, which intend to provide benefits for the supine, side, and stomach sleepers for all ages from newborn babies to elderlies.

A pillow is a very important part of a human's health and it is an essential factor that a person must have a pillow that supports one's cervical and thoracic spine alignment. The conventional pillows are mostly rectangular in shape with a lateral convex style. When a person lays down on a supine position, between the top lateral layer of the conventional pillow and person's occiput becomes two lateral convex shapes touching the highest point of each other, therefore, the cervical and thoracic spine would be curved forward and it creates discomfort for the upper body anatomy and/or disrupt of the cervical and thoracic spine alignment which can oftentimes turn into a painful injury of the cervical spine. On the other hand, the side sleeping position, the pillow is not high enough to support one's cervical and thoracic spine alignment. Many people are still accustomed to the conventional pillows, therefore, they sleep with multiple pillows or use their hands or arms to raise the height of their pillows for the side sleeping position.

There are many types of therapeutic relevant prior arts that are available. However, a large number of them are made with a prefixed design with limited space for the head and neck, and filled with soft materials or shaped with different types of foam. Others are similar to an assembly of blocks of foam which might not necessarily work for every individual user or benefit from it.

This invention is to improve conventional pillows and relevant prior art therapeutic pillows by creating a tiered embodiment configuration apparatus with soft foam which comprises three part tiered panels (left, center, and right panels) and assemble 2-4 pieces to make them similar to conventional pillows and casing up the entire embodiment with the soft foam or corpulent material.

This system and method provides a softness for the pillow surface and at the same time it allows flexibility for self adjustment of depth and width by releasing one's head and neck from pressure into the embodiment configuration via the top layer (cover) into the open space (between tiers) in which it fluctuates based on one's weight and size of the head and neck. This means if there is no pressure on the top of the pillow, the top layer (cover) will bounce back. If there is pressure, then it goes down deeper so it can fit one's head and neck size. This works according to the pressure along with the opposing side of the slanted layers to help to fluctuate the depth and width. Therefore for either the supine position or the left or right lateral recumbent position, users can roll over smoothly from the supine position to either the left or right orientation without lifting their head.

Additionally, this invention comprises a body pillow along with a head pillow as one pillow system. The therapeutic pillow is not completely supportive of all three regions of the spine and hip joint anatomy, which are as equally important as the head and neck supporting pillow in order to support the entire alignment of the upper body spine as well as the lower part of the human body. They all work together for the overall body alignment system and are composed with different regional curvatures in different regions. Preferably the head and body pillows are detachable or attachable in order to be flexible for distance for the two apparatus or it can be inserted separately into a divided and sectioned case for both the head and body pillow which provides relief for the shoulder apparatus by creating a room (space) between the head and body pillows for an anatomy of bones and joints of the shoulder which is the biggest area of the human upper body. Another method is to place the body pillow under the fitted bed sheet and make it stabilized and the head pillow can be on the top of the bed sheet as a conventional method and keep the space between so it will give a tunnel effect for the shoulder and arm. The body pillow starts near the underarm area. Therefore, the head pillow with the neck support and support from the upper area of the body pillow will reduce the shoulder pressure significantly. The spinal anatomy is continuously connected through the human's body such as the hip and knees and all the way to the toes. The curvature of the middle section (hip area) of the body is convex shape. In many cases, the top of the bed mattress pad is not sufficient enough for a full support, therefore creating a disruption of the alignment of the hip and knee joints including the lumbar region.

This body pillow embodies similar to a rectangular shape and a slanted indentation in the center area and approximately two fifths distance from the edge of the upper body, neck area (various in distance to match with the one's hip area) to the edges of the feet area and the opposing side, preferably angled from the center to the opposing directions toward left and right to match the head pillow of the horizontal curve. The indentation of the center is an oval shape and gradual upward slope from the center all around with a long and gentle upward slope from hip area to leg area. The materials and method of finishing the body pillow is preferably the same as the head pillow. The upper body area of the body pillow should be approximately a half lower than the head pillow in height, 2"-3".

The size and shape of the head and body pillow apparatus can be adjusted to meet the users need or can be customized under the similar system and method. Furthermore, this head and body pillow can be attached together for children or make a one piece for the new born babies. These methods can be optional or custom designed.

This system and method is not limited to making pillows only and can be utilized on any other similar products, such as couches, chairs, or car seats, etc.

Multiple choices of pillow shapes (five suggested samples in drawings) are available, as well as various pillow sizes or multiple tier system patterns.

FIG. 1 Showing the completed brio top conventional standard/queen size pillow. The interior tiered embodiment configuration is not visible from the outside view. This lateral concave shape pillow provides room for the occipital and cervical area when one is lying in a supine position and a convex curve shape for both curved vertical edges are angled for one's head for the side sleeping position. Top layer (cover) 1 and bottom layer (cover) 2 are attached 3 using the glue, zipper or other products. Five different ornamental design examples are showing on FIG. 23. A through E. on page 11.

Figure 2:
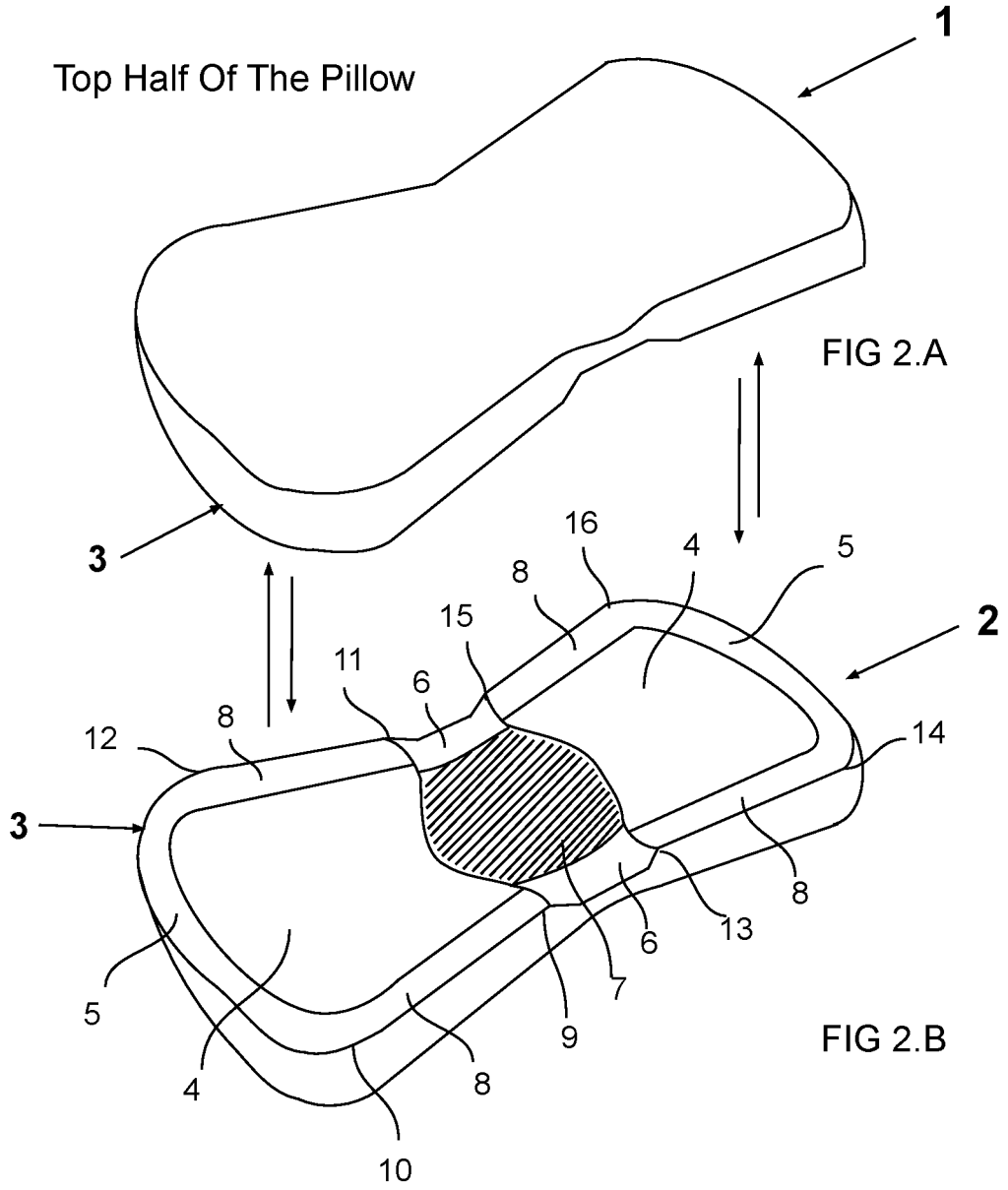

FIG. 2 Two part attachment method (Option 1)

FIG. 2. A, B, Showing, two pieces 1 and 2 of a prefabricated embodiment assembly, flat side facing opposing directions and attach 2nd tier of all 5 and 8 and will be facing each other for an attachment option 1. Casing with thick corpulent soft material is not required but is still optional.

The first tier 7 of 2 is simply an indented area, approximately one third deep of 2 and room for occiput for a supine position and the remaining of the first tier 4 is for the side of the face and both vertical curvature edges 5 are for holding and cuddling of the human head for side sleepers and the horizontal top and bottom 8, except for the center area 6, are also for neck support for a side sleeping position. The neck supporting area 6 for the supine positions are nearly the same level as 4. This horizontal curvature of the pillow is slightly angled, approximately 15-20 degrees from the horizontal center area 9 to 10, 11 to 12, 13 to 14, and 15 to 16.

Figure 3:
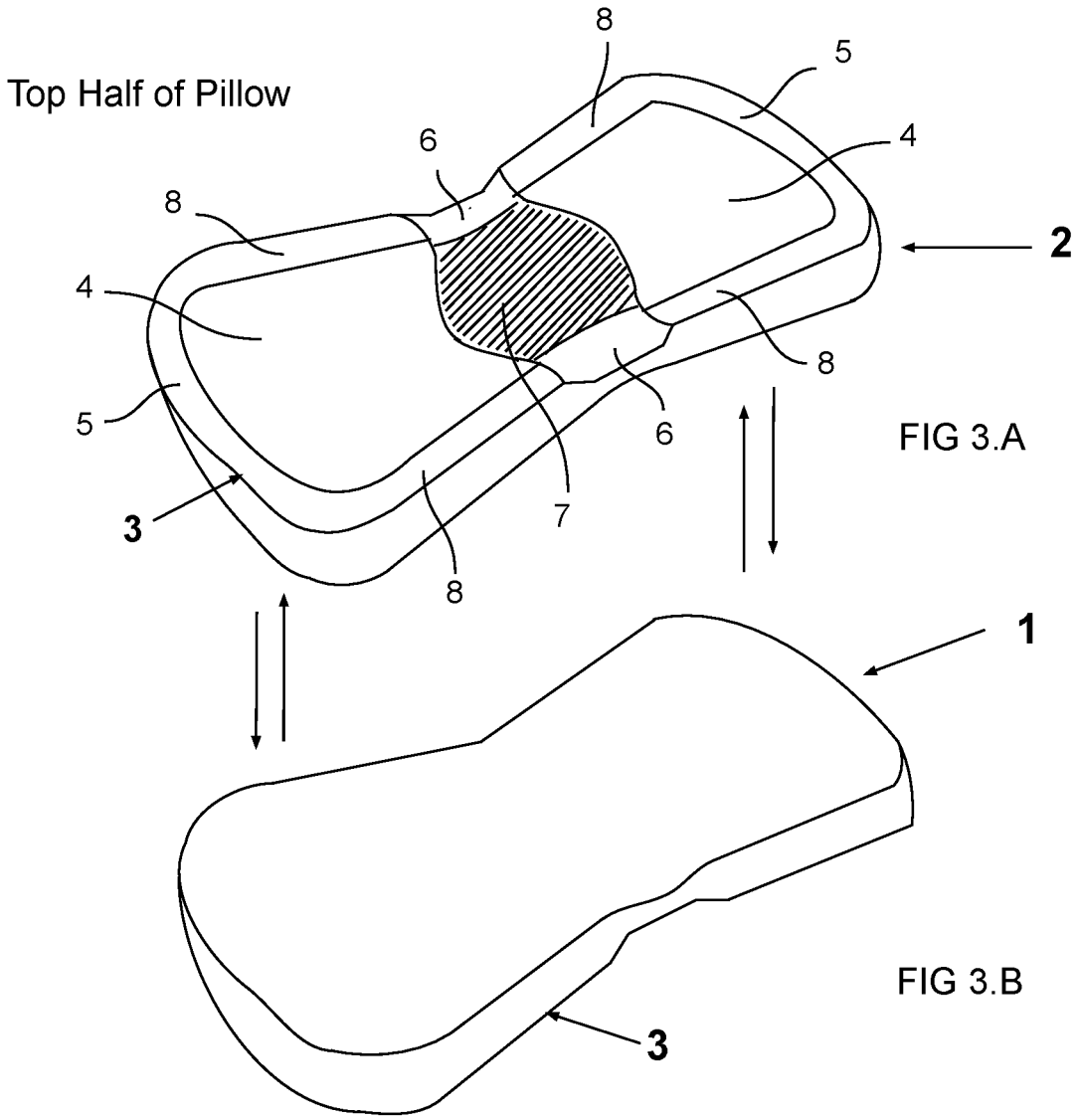
FIG. 3 Reverse attachment of FIG. 2 (Option 2)
FIG. 3.A Three piece assembly for interior embodiment, top layer—option 2
FIG. 3.B Three piece assembly for interior embodiment, bottom layer—option 2
FIG. 4 Three (or four) part attachment method.

FIG. 3 Reverse attachment of FIG. 2 (Option 2)

FIG. 3. A, B. Showing a diagram of two pieces 1 and 2 of a prefabricated embodiment assembly, flat side facing each other to make a complete interior embodiment. Reverse attachment of option 1 FIG. 2

Figure 4:
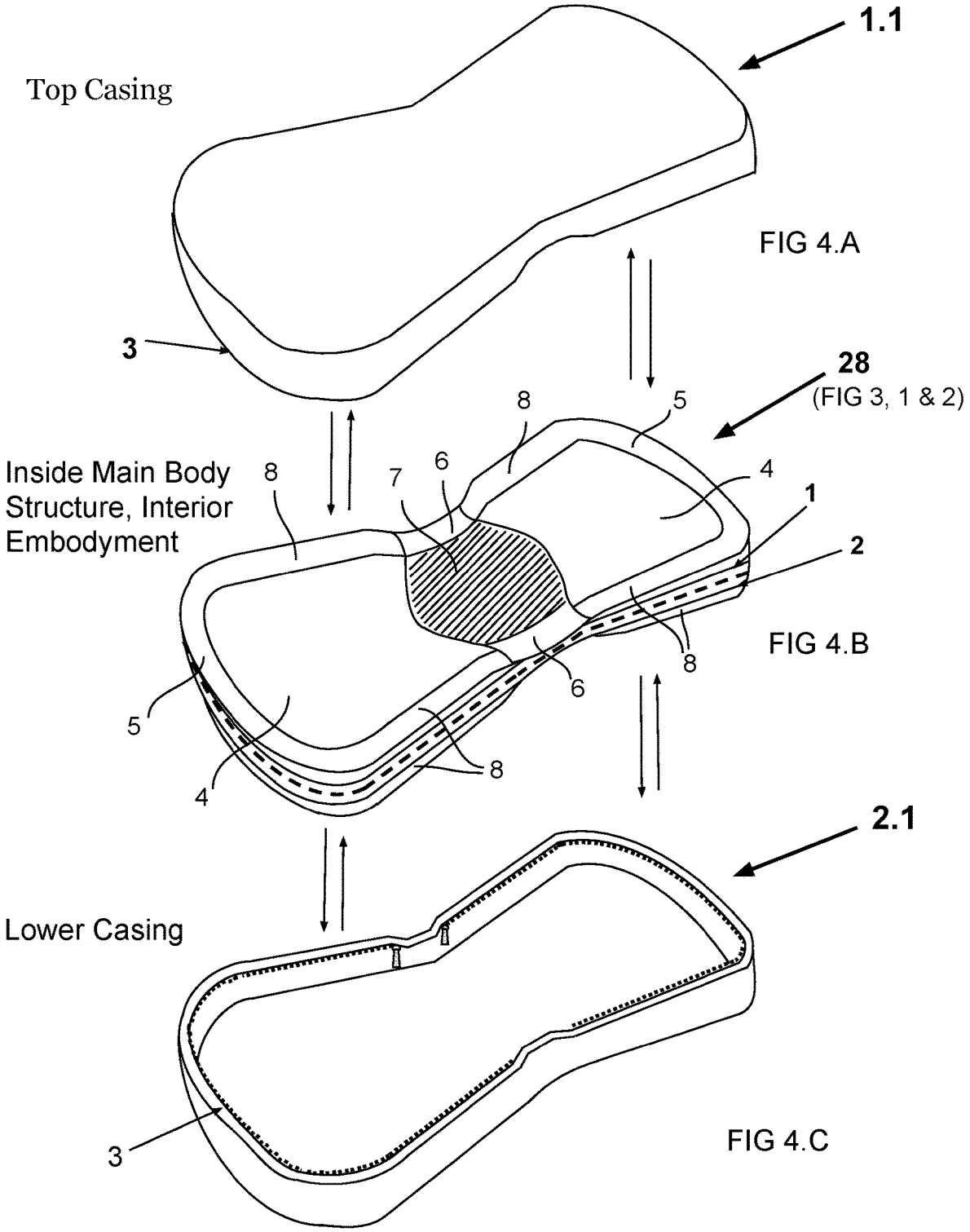
FIG. 4.A Three piece assembly, top casing—option 2
FIG. 4.B Interior mail body structure, interior embodiment—FIG. 3
FIG. 4.C Three piece assembly, lower casing—option 2
FIG. 5 Horizontal and vertical inside view indicator
FIG. 6 Horizontal inside view
FIG. 7 Vertical inside view
FIG. 8 Lateral interior view
FIG. 9 Flat top and bottom inside view with different identification
FIG. 10 Overall view of completed pillow with air vent area—optional
FIG. 11 Side view of vertical cut—balloon or other method of filling option to adjust height of pillow
FIG. 12 Side view of vertical cut—balloon or other method of filling option to adjust height of pillow
FIG. 13 Side view of vertical cut—balloon or other method of filling option to adjust height of pillow
FIG. 14 Side view of vertical cut—balloon or other method of filling option to adjust height of pillow
FIG. 15 Flat top internal view of lateral horizontal cut
FIG. 16 Exterior view of body pillow
FIG. 17 Interior view of the body pillow
FIG. 18 Exterior layout view of the head and body pillow
FIG. 19 Example of laying on head and body pillow front view
FIG. 20 Examples of laying on head and body pillow rear view
FIG. 21 Vertical cut view of interior tier option, two part attachment method (Option 1)
FIG. 21.A-FIG. 21.F
FIG. 22 Horizontal cut view of interior tier option, two part attachment method (Option 1)
FIG. 22.A-FIG. 22.F
FIG. 23 Exterior ornamental design option
FIG. 23.A-FIG. 23.E

FIG. 4 Three (or four) part attachment method.

FIG. 4. A, B, C. Showing three pieces 1.1, 2.1, and 28 (FIG. 3) of assembly and casing with soft foam approximately 1 inch (+/−) thick or corpulent material using glue, zipper 3, or other method for the attachment. The attachment 3 can be partially done in order to add additional pieces to fill and adjust the height or rest area of 3 will be permanently attached between covers 1.1 and 2.1. Both covers 1.1 and 2.1 will lead to fluctuating depth and width based on the indentation of the embodiment for the head and neck so it fits into the pillow and allows support for cervical spine alignment. When there is no pressure, covers 1.1 and 2.1 will bounce back.

Figure 5:
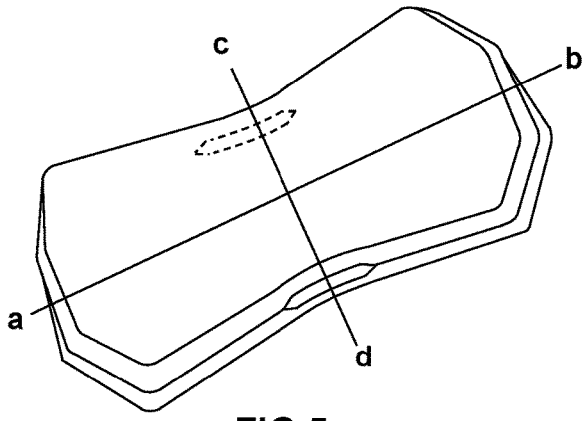

FIG. 5 Showing a diagram of the area of the vertical interior view.

Figure 6:
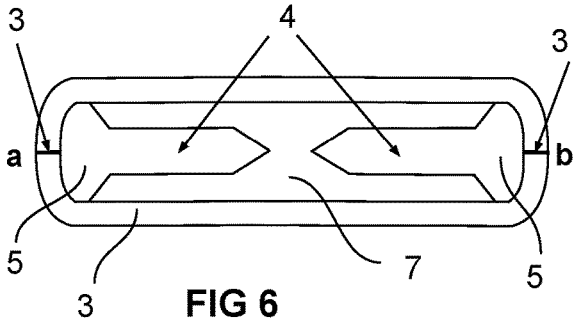

FIG. 6 Showing the section of the interior view of a. and b.

Figure 7:
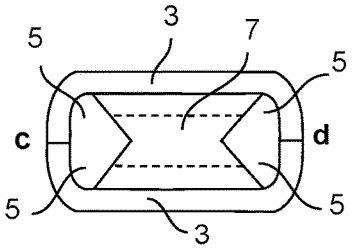

FIG. 7. Showing the section of the interior view of c. and d.

Figure 8:
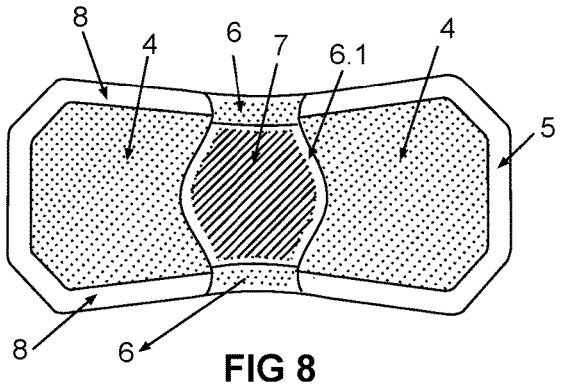

FIG. 8, Showing the lateral interior view

Figure 9:
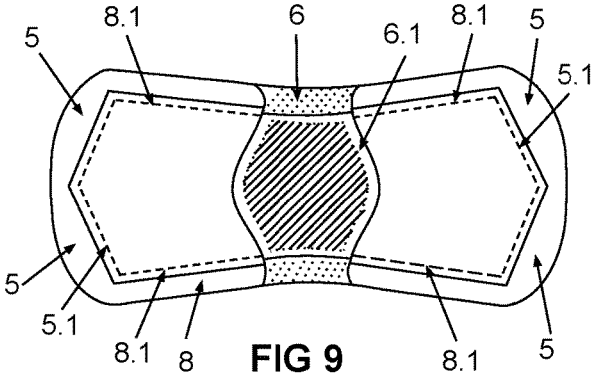

FIG. 9 Showing the lateral interior view, gradually slanted area 5.1, 6.1, and 8.1

Figure 10:
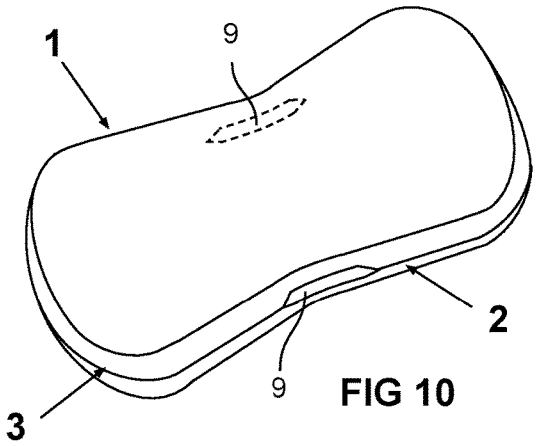

FIG. 10 Showing the air vent option 9.

FIG. 11, FIG. 12, Balloon options

FIG. 13, FIG. 14, Different cut options

FIG. 15 Showing the method for additional adjustment of the depth and width by adding a pad or a balloon, or something similar.

Figure 16:
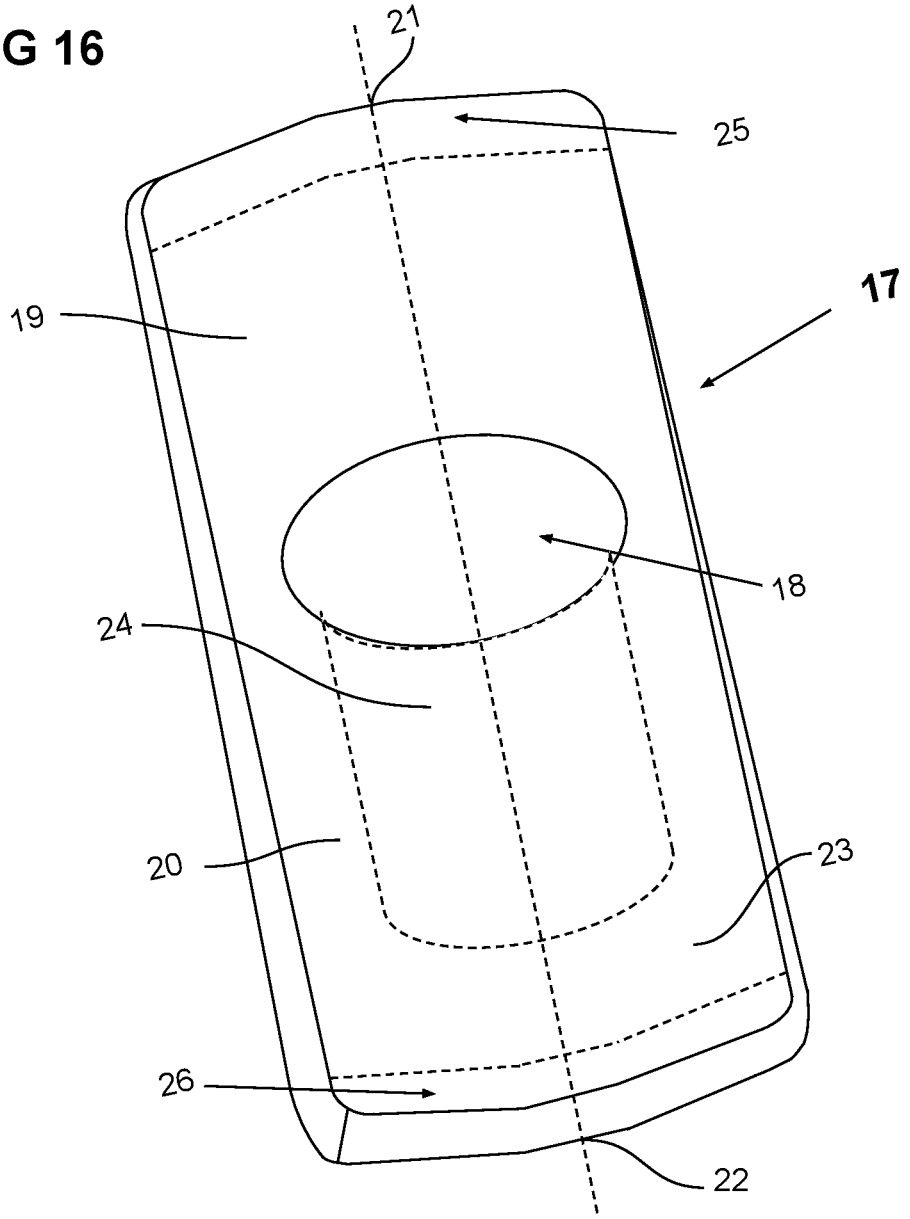

FIG. 16 Showing the exterior view of the body pillow. It is a rectangular shape and the top edge 21 is to be lined up to the curvature horizontal edge of the head pillow and the human hip to be positioned 18 with the slanted indentation is approximately one third of the total thickness on one side or option on the opposing side as well on the upper body area 19 and lower body area 20 both adjacent to 18 can be slanted. It is optional 25 (wider) and 26 (narrower) can be switched to make a small adjustment for the distance on the hip area and it is an optional design.

Figure 17:
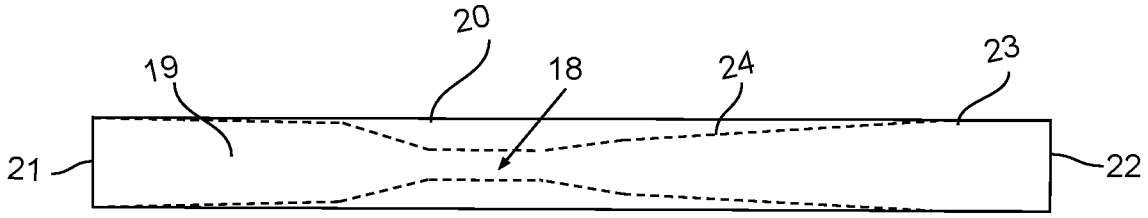

FIG. 17 Showing the interior vertical view of the body pillow from 21 to 22 and from hip area 18 to both opposing directions to 19 and 23 are gradually raised only in the center part of the body pillow.

Figure 18:
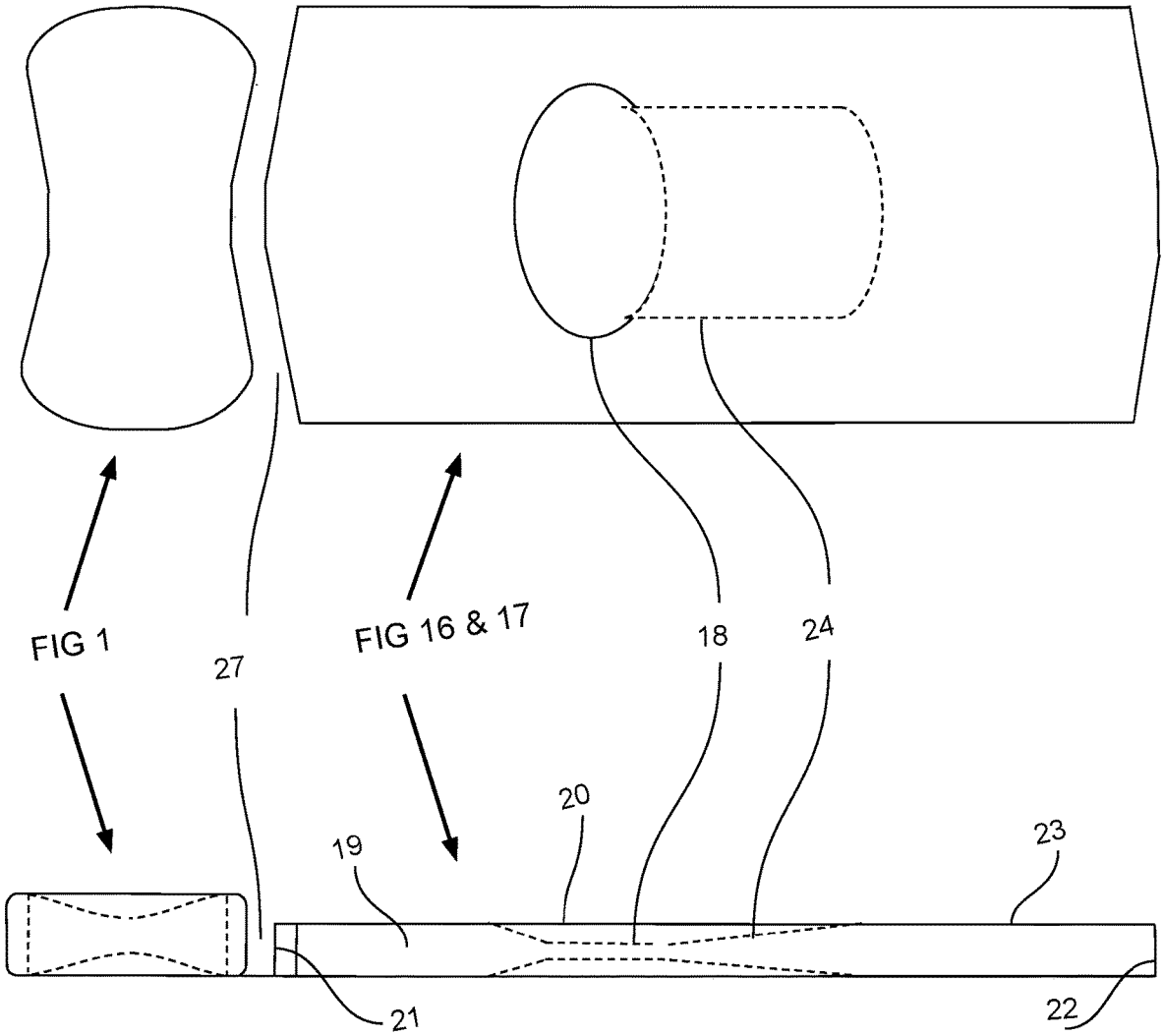

FIG. 18 Lay out of FIG. 1 and FIG. 17. Section for shoulder and arm joint area 27.

Figure 19:
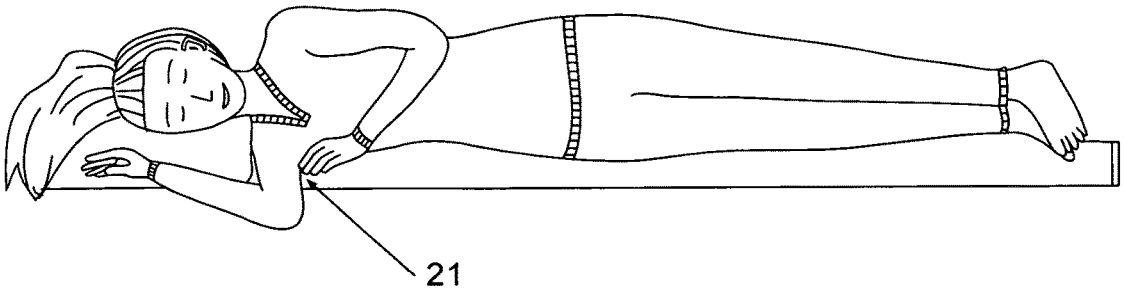

FIG. 19 Showing examples of laying on head and body pillow front view.

Lift and hold up the upper body to reduce the pressure on the shoulder. 21

Figure 20:
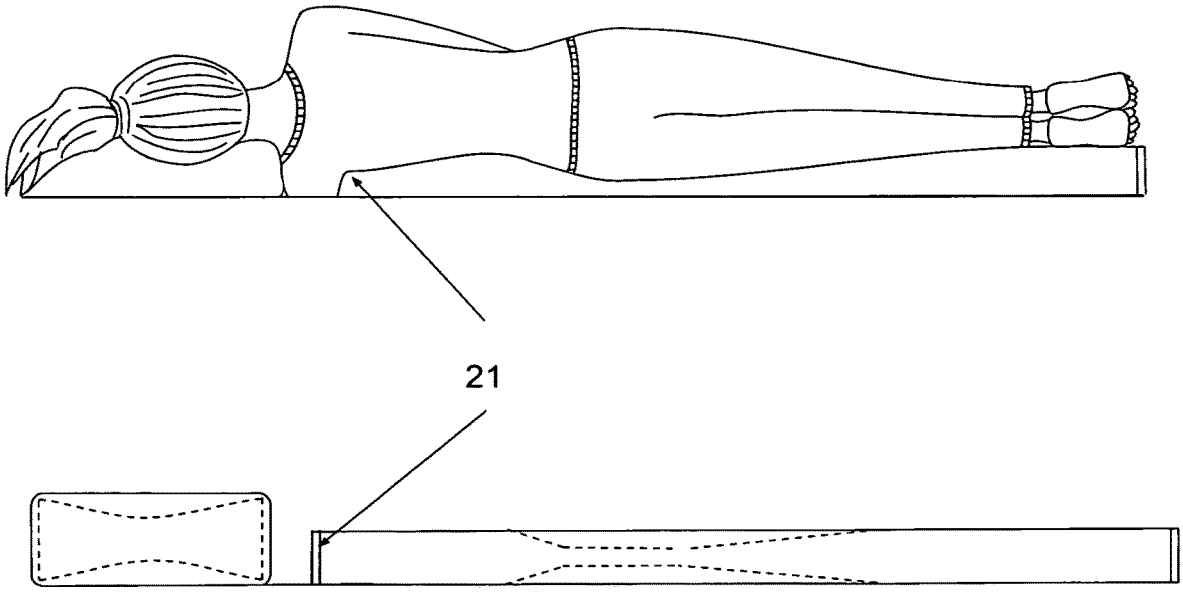

FIG. 20 Showing examples of laying on head and body pillow rear view.

Lift and hold up the upper body to reduce the pressure on the shoulder. 21

Figures 21, 22:
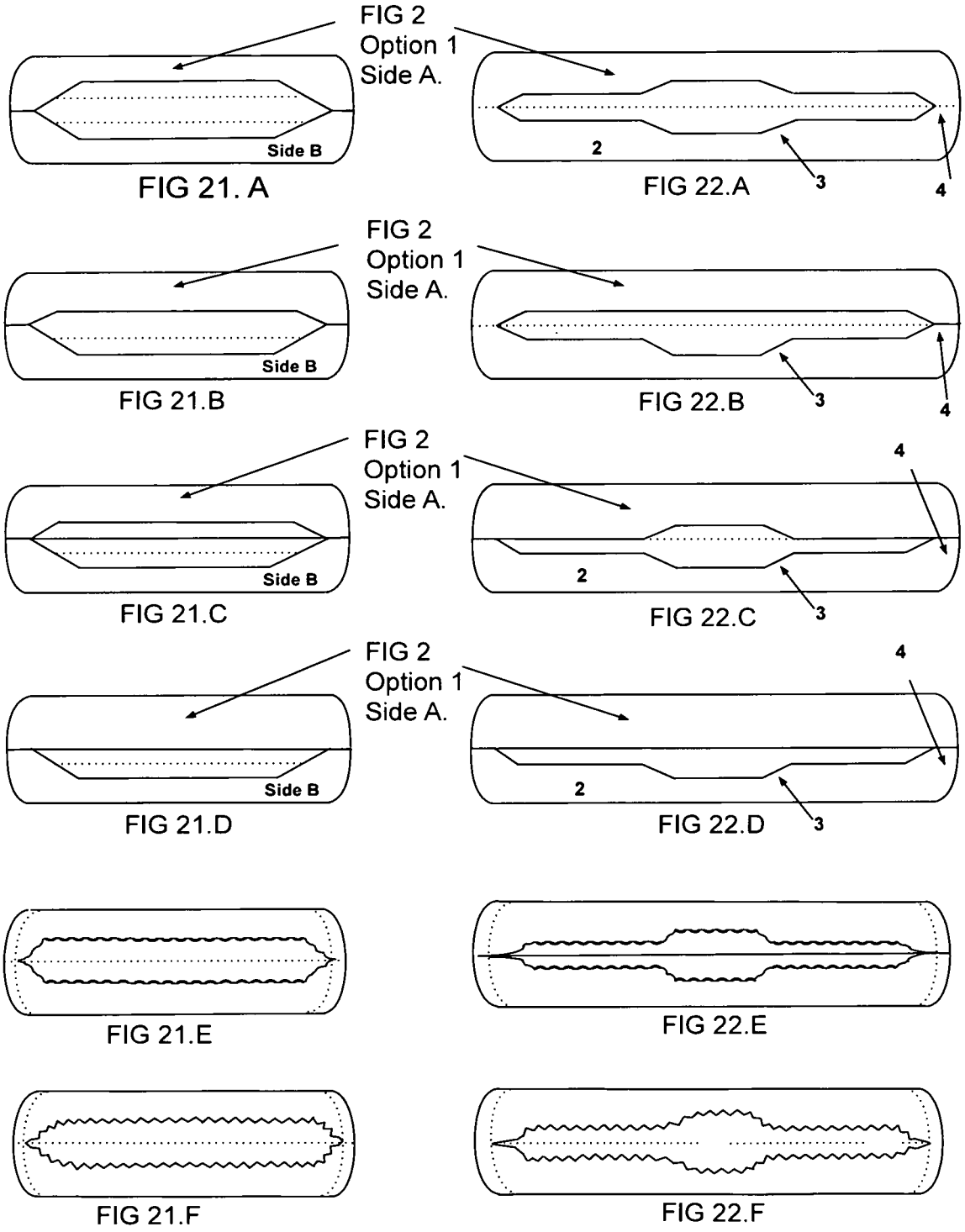

FIG. 21 Vertical cut view

FIGS. 21 A-21 F Vertical cut view—Optional embodiment to meet individual design preference. Option 1

FIG. 22 Horizontal cut view

FIGS. 22 A-21 F Horizontal cut view—Optional embodiment to meet individual design preference.

FIG. 23 Exterior ornamental design option

FIG. 23.A-FIG. 23.E Showing samples of ornamental design.option

REFERENCES CITED

1. U.S. Pat. No. 9,113,732 B2
2. U.S. Pat. No. 9,757,303B2
3. US 20180028352 A1
4. US 20160213176 A1
5. US 20150282647 A1
6. JP2014111156A
7. U.S. Pat. No. 6,006,380 A
8. U.S. Pat. No. 5,038,432 A
9. U.S. Pat. No. 7,082,633B1
10. U.S. 68/704,961
11. U.S. 66/719,0681.
12. U.S. Pat. No. 5,864,904A
13. U.S. Pat. No. 5,016,303A
14. U.S. Pat. No. 5,363,524A
15. U.S. 65/317,961
16. U.S. Pat. No. 4,829,614 A
17. U.S. Pat. No. 7,788,750 B2
18. U.S. Pat. No. 6,931,682 B2
19. U.S. Pat. No. 5,644,810 A
20. U.S. Pat. No. 5,471,691 A

FIELD OF THE INVENTION

This invention relates to head and body pillow supporting the spinal anatomy alignment and designed for an assembly of multiple pieces of prefabricated soft foam or various corpulent soft cushion materials for all ages from newborn babies to elderly.

The invention claimed is:

1. A bowtie-shaped head pillow comprising:

a left side, a right side, a front side, a back side, a top, and a bottom;

a three-tiered system comprising:

a center section, a left section, and a right section, with the left and right section being substantially mirror images of each other;

the center section comprising a slanted hole configured to support a user's occiput;

the left section comprising a foam piece that has a v-shaped cross-section bordering a left side of the hole of the center section, a substantially rectangular cross-section extending laterally toward the left side of the pillow from the v-shaped cross-section, and a top and bottom of the rectangular cross-section flaring out toward the top and bottom of the pillow, respectively, at the left side of the pillow;

the right section comprising a foam piece that has a v-shaped cross-section bordering a right side of the hole of the center section, a substantially rectangular cross-section extending laterally toward the right side of the pillow from the v-shaped cross-section, and a top and bottom of the rectangular cross-section flaring out toward the top and bottom of the pillow, respectively, at the right side of the pillow;

the center section being bordered by an indented neck supporting area at the front and back side of the pillow; and the three tiered-system encased by a top cover and a bottom cover, the top cover and bottom cover attached to each other.

2. A head and body pillow system comprising:

the bowtie-shaped head pillow of claim 1;

a body pillow comprising an upper body area and a lower body area, with a hip area located between the upper body area and the lower body area;

the hip area comprising an indentation, with the lower body area and the upper body area slanting adjacent the indentation;

the bowtie-shaped head pillow and the body pillow spaced apart from each other to create an arm joint area.

* * * * *